United States Patent [19]

Hesse et al.

[11] 4,124,137

[45] Nov. 7, 1978

[54] EXHAUST GAS VENT TUBE

[75] Inventors: Jürgen Hesse, Düsseldorf; Dieter Schulzki, Duisburg, both of Germany

[73] Assignee: Messer Griesheim GmbH, Frankfurt am Main, Germany

[21] Appl. No.: 761,774

[22] Filed: Jan. 24, 1977

[30] Foreign Application Priority Data

Feb. 11, 1976 [DE] Fed. Rep. of Germany ..... 2605321

[51] Int. Cl.[2] ..... B65D 3/18; B65D 25/00

[52] U.S. Cl. ..... 220/86 R; 141/198; 141/286; 137/590

[58] Field of Search ..... 137/592, 590; 62/45; 141/198, 285, 286; 220/86 R, 469

[56] References Cited

U.S. PATENT DOCUMENTS

| | | | |
|---|---|---|---|
| 2,123,809 | 7/1938 | Seitz | 137/592 |
| 3,342,193 | 9/1967 | Deering et al. | 137/592 X |
| 3,377,813 | 4/1968 | Mordhorst | 62/45 |
| 3,565,045 | 2/1971 | Knox, Jr. | 137/592 X |
| 3,643,465 | 2/1972 | Bottum | 137/592 |
| 3,661,191 | 5/1972 | Harley et al. | 141/198 X |
| 3,817,421 | 6/1974 | Andres | 220/86 R X |

FOREIGN PATENT DOCUMENTS

| | | |
|---|---|---|
| 2,323,020 | 1/1975 | Fed. Rep. of Germany. |
| 1,453,534 | 10/1976 | United Kingdom. |

*Primary Examiner*—Davis T. Moorhead

*Attorney, Agent, or Firm*—Connolly and Hutz

[57] ABSTRACT

An exhaust tube for cryothermal vessels includes means for deflecting the exhaust gas upon entry into the tube.

5 Claims, 2 Drawing Figures

EXHAUST GAS VENT TUBE

BACKGROUND OF THE INVENTION

The invention is concerned with an exhaust gas vent tube for upright or stationary cryogenic vessels. The exhaust tube on such double walled insulated vessels for low boiling liquidfied gases serves to channel the gas occurring in the vessel prior to filling and the gas resulting from the filling of the vessel. The tube also serves as overflow drain and is used to limit the maximum fill to 95% of the geometric volume of the vessel. Such an exhaust tube consists, in the interior of the vessel, solely of a vertical pipe open at the bottom. The end of the tube is at the aimed for or desired level of the liquid. During filling, the addition of liquid gases is interrupted as soon as the droplets of liquid come out of the exhaust tube, since these droplets are an indication that the surface of the liquid has reached the end of the exhaust tube.

It was determined by means of weighing that, upon appearance of the first droplets of liquid, the vessel was not, as previously assumed, 95% filled, but short of the maximum fill. This phenomenon is dependent on pressure, that is, the higher the pressure or boiling temperature of the cryogenic liquid in the storage vessel, the greater the difference between maximum and effective fill. The reason for this can be attributed to the drop in pressure occurring during transfer due to sudden vaporization of part of the low boiling gas. Since the fill tube ends at the deepest part in the interior of the cryogenic vessel the gas bubbles which are formed there on account of the drop in pressure and through partial vaporization of the cryogenic liquid, rise through the column of liquid into the gaseous part or headspace. When the bubbles leave the liquid, they pull droplets of liquid with them. At the exit from the exhaust tube into the open, there appears a mixture of gas and liquid. The supply of liquid is thus already stopped prior to the vessel being filled up to maximum weight. The smaller a vessel's diameter, the more this effect is noticeable.

SUMMARY OF THE INVENTION

An object of the invention is to achieve an exhaust tube which insures a maximum fill of the vessel.

According to the invention, this is attained by a profile and/or insertions built into the exhaust tube, by means of which a deflection of the exhaust gas is induced upon entry into exhaust tube. As a result of the deflection of the exhaust gas stream, the droplets of liquid which were pulled along are shaken off because of their moments of inertia. Droplets of liquid come out of the exhaust tube only when the surface of the liquid has reached the opening in the exhaust tube.

The deflection of the exhaust stream can be attained in various ways. The last part or terminus of the exhaust tube occurring in the vessel can, for example, be bent 90° in a horizontal plane. The bending can also be corkscrew or spiral shaped. Resistances to the flow can be provided at the end of the exhaust tube occurring in the vessel which effect a deflection and an acceleration of the gas stream in the tube.

The object of the invention is optimally attained when the exhaust tube in the vessel is designed as in the form of a vertical pipe the opening of which is sealed and which instead possesses a side opening at the height of the aimed for level of liquid. The sealed end of the tube is located, preferably immediately under the side opening. It is advantageous to have the cross section area of the side opening the same size as the cross section area of the tube.

THE DRAWING

FIG. 1 schematically illustrates a cryogenic vessel incorporating the exhaust tube of this invention; and FIG. 2 illustrates an exhaust tube, according to the invention, with sealed end of the tube and with a side opening.

DETAILED DESCRIPTION

Figure 1:
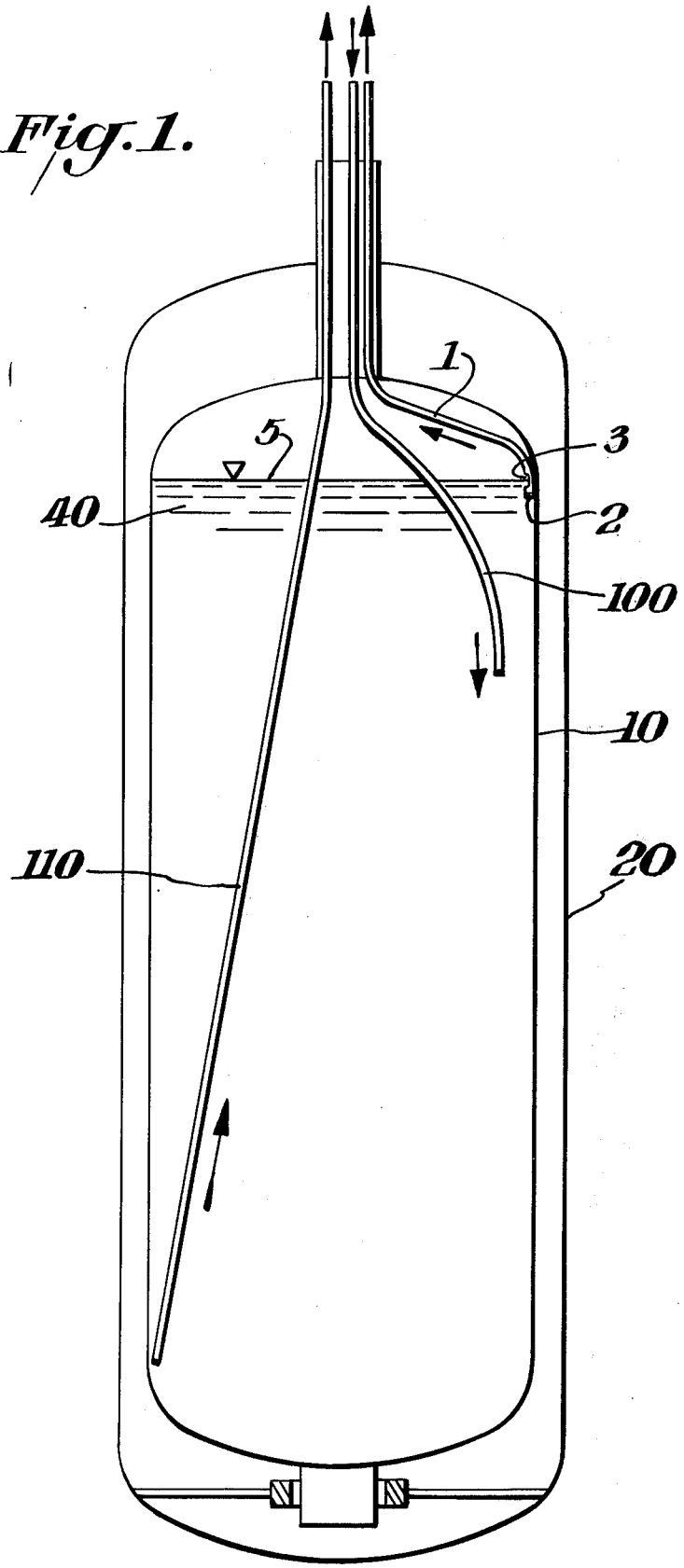

In the drawings, the end of a vertical exhaust tube 1, occurring in the vessel is illustrated. Since the vessel itself is of known construction an illustration and description thereof is omitted herefrom. FIG. 1 does, however, illustrate a cryogenic vessel of the type disclosed in German Pat. No. DT 2,323,020 and British Pat. No. 1,453,534. As indicated therein the cryogenic vessel includes an inner container 10 and an outer container 20 with a filling pipe 100 extending into the inner container for supplying the cryogenic liquid 40. The vessel also includes a liquid withdrawing pipe 110 as well as the exhaust tube 1. Unlike these patents, however, exhaust tube 1 does not terminate in an open end but is of a structure more fully shown in FIG. 2 and described hereafter.

Figure 2:
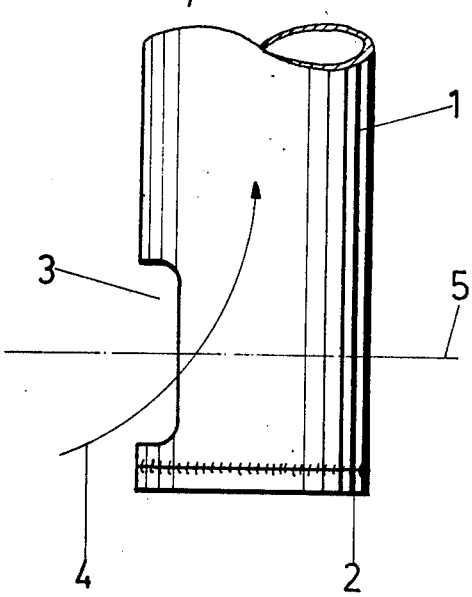

As shown in FIG. 2 the end of the tube is sealed by means of a plate 2, unlike conventional tubes having an open end thereof. Immediately above the plate 2, there is a side opening 3, the cross section of which corresponds roughly to the cross section of the tube. The arrow 4 indicates the flow path of the exhaust gas. By means of the sharp deflection of the flow path, the droplets occurring in the exhaust gas are shaken off, and droplets of liquid only reach the outside through the exhaust tube 1, when the surface of the liquid 5 is at the height of the side opening 3.

The following experimental examples show the efficiency of the inventive exhaust tube:

A cryogenic vessel with a geometric fill volume of 162 liters (correspondingly 154 liters for 95% fill) is filled with liquid nitrogen from a storage vessel which is under a pressure of 2 bar. With the conventional design of the exhaust tube as a vertical pipe, there results a fill of 138 liters.

With a design of the exhaust tube according to the invention, however, there results in all cases the aimed for fill of 154 liters.

A two vessel layout with a 95% fill volume of 2 × 72.5 liters can only be filled with 110 liters with the conventional exhaust tube. In contrast, however, by designing the exhaust tube according to the drawing a fill of 145 liters is obtained. From the experimental example, it follows that the efficiency of the invention's exhaust tube is greater, when the diameter of the vessel is smaller.

What is claimed is:

1. In an upright cryogenic vessel having a filling pipe for filling the vessel with a low-boiling cryogenic liquid to a predetermined level in the vessel and having a vertically extending exhaust tube in the vessel extending to the predetermined level and leading to the exterior of the vessel for discharging exhaust gas which occurs during the filling process whereby the occurrence of liquid in the exhaust tube indicates the completion of the filling process and the reaching of the predetermined level by the liquid, the improvement being said exhaust tube including deflection means for separating droplets of liquid by deflection of the exhaust gas stream, said exhaust tube being closed at its end below said predetermined level and having a side inlet opening at said predetermined level to comprise said deflection means.

2. In the vessel of claim 1 wherein said end of said exhaust tube is closed by means of a plate sealing said end, and said side inlet opening being located directly above said plate.

3. In the vessel of claim 1 wherein said vessel is of double walled construction, and said cryogenic liquid is nitrogen which fills said vessel to said predetermined level.

4. In the vessel of claim 2 wherein the cross section area of said side opening is the same size as the cross section area of said exhaust tube.

5. In the vessel of claim 1 wherein the cross section area of said side opening is the same size as the cross section area of said exhaust.

* * * * *